US005488900A

United States Patent [19]

Sundqvist

[11] Patent Number: 5,488,900

[45] Date of Patent: Feb. 6, 1996

[54] DEWATERING PRESS

[75] Inventor: Ingemar Sundqvist, Bergeforsen, Sweden

[73] Assignee: Sunds Defibrator Industries AB, Sweden

[21] Appl. No.: 306,203

[22] Filed: Sep. 14, 1994

[30] Foreign Application Priority Data

Sep. 15, 1993 [SE] Sweden ..... 9302994

[51] Int. Cl.[6] ..... B30B 9/20

[52] U.S. Cl. ..... 100/121; 239/562; 239/566; 239/598

[58] Field of Search ..... 100/121, 173; 162/358.1; 210/386, 770, 456; 239/562, 565, 566, 598

[56] References Cited

U.S. PATENT DOCUMENTS 2,807,998 10/1957 Stephan ..... 100/121
4,543,161 9/1985 Fujimoto ..... 100/121
5,063,840 11/1991 Vote .

FOREIGN PATENT DOCUMENTS 115883 12/1876 France ..... 100/121
18877 8/1882 Germany ..... 100/121
8706282 10/1987 WIPO .

*Primary Examiner*—David Scherbel
*Assistant Examiner*—Terrence R. Till
*Attorney, Agent, or Firm*—Lerner, David, Littenberg, Krumholz & Mentlik

[57] ABSTRACT

Apparatus for dewatering material suspensions is disclosed including a pair of rotatable cylindrical liquid permeable press rolls at least partially immersed in a vat, inlet channels for supplying the material suspension to the bottom portion of the vat, transverse distribution pipes for distributing the material suspension to the inlet channels, and a central pipe for supplying the material suspension to the transverse distribution pipes, the central pipe including an adjustable outer sleeve axially adjustable therealong and connected to an openable portion at the bottom of the vat so that the adjustable outer sleeve and the openable portion of the vat can be adjusted between an upper closed position for normal operation of the apparatus and a lower open position in which access is provided to the space between the press rolls and the bottom of the vat, the central pipe including apertures so that when the adjustable outer sleeve and the openable portion of the vat are in the upper closed position, the apertures provide communication between the central pipe and the transverse distribution pipes.

5 Claims, 2 Drawing Sheets

DEWATERING PRESS

FIELD OF THE INVENTION

This invention relates to a press for dewatering material suspensions, for example pulp suspensions.

BACKGROUND OF THE INVENTION

A press comprises two cooperating rolls, which form a nip between them. The rolls are located in a vat, to which the material suspension is supplied. The rolls are formed with liquid permeable shell surfaces, so that the suspension is dewatered by pressing liquid into the rolls by means of an overpressure. The final dewatering to attain the desired dry matter content of the material takes place in the nip. The dry matter content can amount to 35–55%.

The rolls immersed into the vat are rotary and are disposed on two parallel shafts, and the vat encloses at least the lower half of the rolls. The material suspension is supplied to the space between the vat and rolls from the bottom of the vat. In order to distribute the suspension uniformly along the entire length of the rolls, the suspension is supplied through a plurality of inlets distributed along the bottom of the vat. The number of inlets depends on the axial length of the rolls, but is usually from about 2–6. A central supply pipe is normally connected to a transverse distribution pipe, which communicates with the inlets.

This structure is simple and yields a very uniform distribution of the material suspension, which is an essential requirement for uniform dewatering, as well as for the quality of the dewatered material. The structure, however, does not allow access to the space between the vat and rolls, for example for the cleaning of clogging which occurs in certain cases. Separate openings or manholes in the vat bottom can certainly allow for limited access. However, in many cases, this is not sufficient for eliminating the clogging. It then becomes necessary to dismantle the press, which, of course, is a complicated and expensive operation.

The present invention offers a solution to the aforesaid problem without giving up any of the advantages thereof.

SUMMARY OF THE INVENTION

In accordance with the present invention, these and other objects can be realized by the invention of apparatus for dewatering material suspensions comprising first and second rotatable cylindrical liquid permeable press rolls juxtaposed with each other to form a nip region therebetween. The apparatus includes a vat, including a bottom portion, the first and second press rolls being at least partially immersed in the vat so as to provide a space between the first and second press rolls and the bottom portion of the vat, inlet means for supplying the material suspensions to the bottom portion of the vat, the bottom portion of the vat including an openable portion, transverse distribution means for distributing the material suspension to the inlet means, central pipe means for supplying the material suspension to the transverse distribution means, the central pipe means including adjustable outer sleeve means axially adjustable along the central pipe means, the adjustable outer sleeve means being connected to the openable portion of the vat whereby the adjustable outer sleeve means and the openable portion of the vat can be adjusted between an upper closed position for normal operation of the apparatus and a lower open position in which access is provided to the space between the first and second press rolls and the bottom portion of the vat, the central pipe means including aperture means whereby when the adjustable outer sleeve means and the openable portion of the vat are in the upper closed position, the aperture means provides communication between the central pipe means and the transverse distribution means.

In accordance with one embodiment of the apparatus of the present invention, the openable portion of the bottom portion of the vat is disposed in a central region of the bottom portion of the vat.

In accordance with another embodiment of the apparatus of the present invention, the inlet means comprises a plurality of inlet channels for supplying the material suspension at a plurality of locations along the bottom portion of the vat. Preferably, the transverse distribution means and the plurality of inlet channels are attached to the adjustable outer sleeve means.

In another embodiment of the apparatus of the present invention, the central pipe means include strut means for supporting the aperture in the central pipe means.

BRIEF DESCRIPTION OF THE DRAWINGS

This invention is described in greater detail in the following detailed description with reference to the accompanying drawings showing an embodiment of the invention, in which.

DETAILED DESCRIPTION

Figure 1:
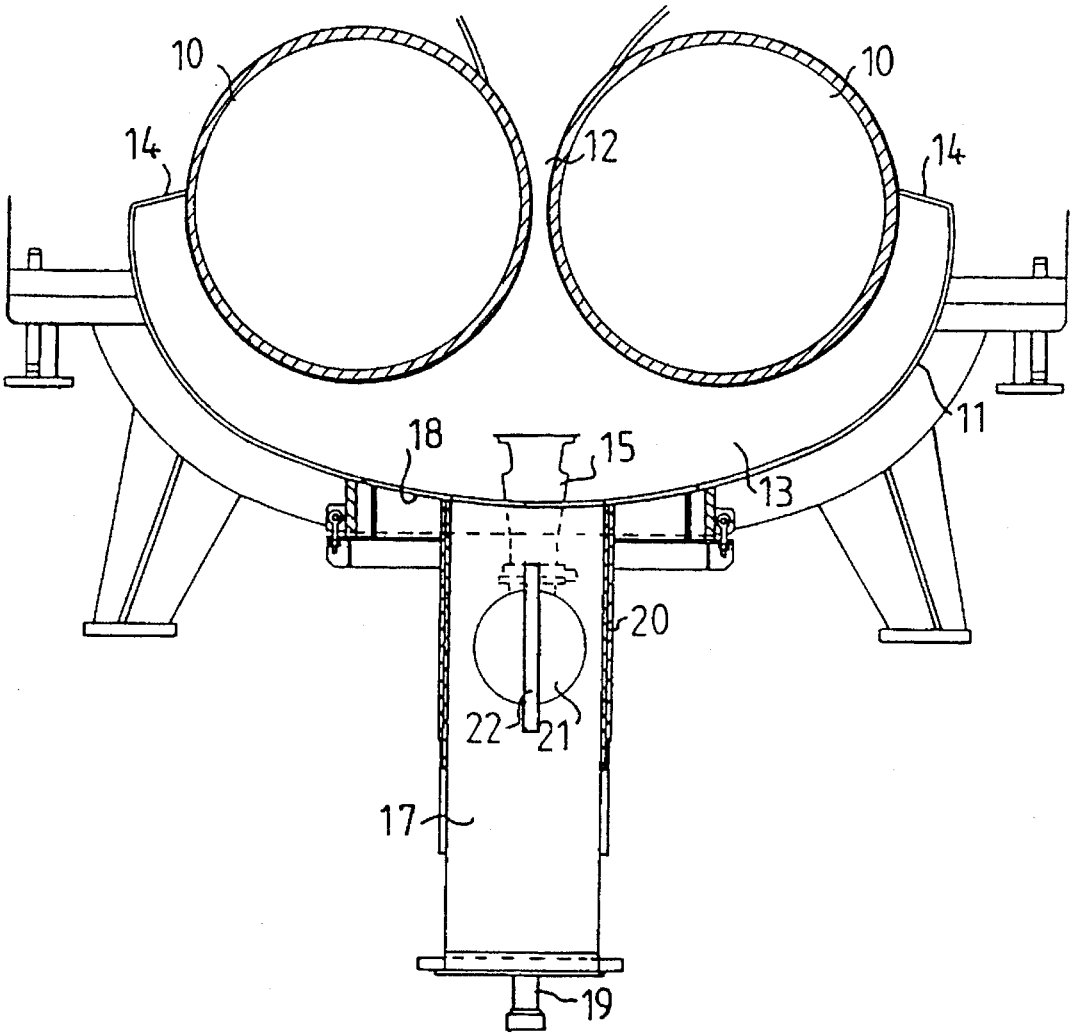
FIG. 1 is a side, elevational, cross-sectional view of a press according to the present invention.
Figure 2:
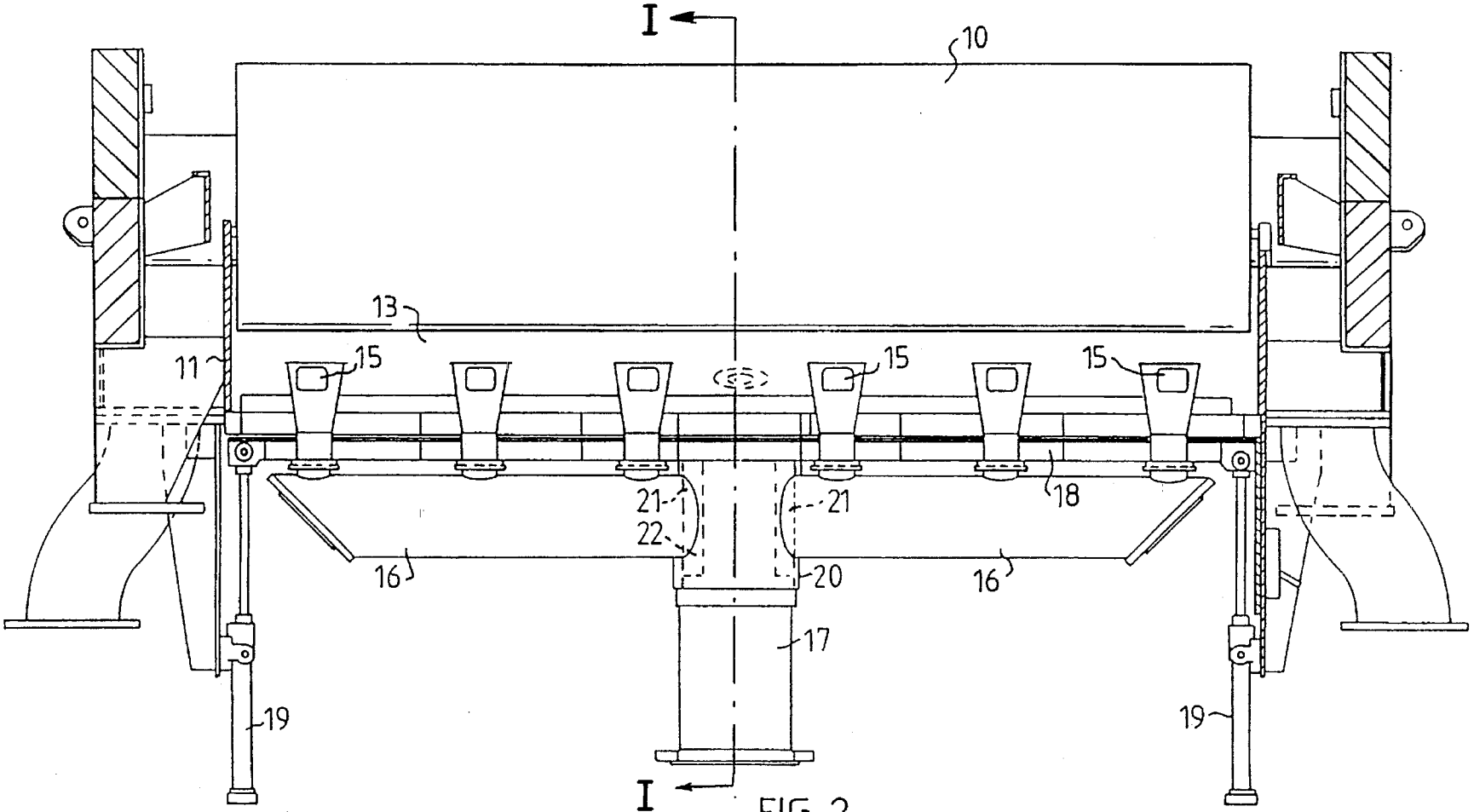
FIG. 2 is a front, elevational, longitudinal section through the press shown in FIG. 1.

The device of the present invention comprises two liquid permeable rolls 10, which are immersed into a vat 11 enclosing the lower portion of the rolls. The rolls form a nip 12 therebetween. A space 13 formed between the vat 11 and rolls 10 is sealed by sealings 14 at the circumference of the rolls as well as at the end walls of the rolls. A plurality of inlets 15 for the material suspension are uniformly distributed along the bottom of the vat 11. These inlets 15 are located on a transverse distribution pipe 16, which is connected to a central supply pipe 17, as can best be seen in FIG. 2. The central pipe 17 is rigidly mounted, while the transverse distribution pipe 16 can be raised and lowered together with a central portion 18 of the vat 11 where the inlets 15 are located. This movement is preferably effected by means of hydraulic cylinders 19. This movement is rendered possible by a telescopic connection between the central pipe 17 and transverse distribution pipe 16. The transverse distribution pipe 16 is thus attached to sleeve 20, which encloses the central pipe 17 and is axially movable in relation thereto. The central pipe 17 is provided with apertures 21, which are located directly in front of the inlets to the transverse distribution pipe when the central portion 18 of the vat is in its upper closed position. In the immersed position of the central portion 18, the apertures 21 are closed by the walls of the central pipe 17. In order to prevent leakage, sealings are provided between the sleeve 20 and central pipe 17. The aforesaid arrangement permits the space 13 to be easily accessible for cleaning without dismantling the press, while at the same time the material suspension can be supplied during operation of the press in an optimum manner for a uniform distribution.

In order to reinforce the structure, the apertures 21 can be provided with struts 22 on the inside of the central pipe 17.

The invention, of course, is not restricted to the embodiment shown, but can be varied within the scope of the invention idea.

We claim:

1. Apparatus for dewatering material suspensions comprising first and second rotatable cylindrical liquid permeable press rolls juxtaposed with each other to form a nip region therebetween, a vat including a bottom portion, said first and second press rolls being at least partially immersed in said vat so as to provide a space between said first and second press rolls and said bottom portion of said vat, inlet means for supplying said material suspension to said bottom portion of said vat, said bottom portion of said vat including an openable portion, transverse distribution means for distributing said material suspension to said inlet means, central pipe means for supplying said material suspension to said transverse distribution means, said central pipe means including adjustable outer sleeve means axially adjustable along said central pipe means, said adjustable outer sleeve means being connected to said openable portion of said vat whereby said adjustable outer sleeve means and said openable portion of said vat is adjusted between an upper closed position for normal operation of said apparatus and a lower open position in which access is provided to said space between said first and second press rolls and said bottom portion of said vat, said central pipe means including aperture means whereby when said adjustable outer sleeve means and said openable portion of said vat are in said upper closed position said aperture means provides communication between said central pipe means and said transverse distribution means.

2. The apparatus of claim 1 wherein said openable portion of said bottom portion of said vat is disposed in a central region of said bottom portion of said vat.

3. The apparatus of claim 1 wherein said inlet means comprises a plurality of inlet channels for supplying said material suspension at a plurality of locations along said bottom portion of said vat.

4. The apparatus of claim 3 wherein said transverse distribution means and said plurality of inlet channels are attached to said adjustable outer sleeve means.

5. The apparatus of claim 1 wherein said central pipe means include strut means for supporting said apertures in said central pipe means.

* * * * *